US009493973B2

(12) United States Patent
Mitchell et al.

(10) Patent No.: US 9,493,973 B2
(45) Date of Patent: Nov. 15, 2016

(54) HINGE

(71) Applicant: Kason Industries, Inc., Newnan, GA (US)

(72) Inventors: Brett A Mitchell, Newnan, GA (US); Jeffery E. Underwood, Newnan, GA (US)

(73) Assignee: Kason Industries, Inc., Newnan, GA (US)

( * ) Notice: Subject to any disclaimer, the term of this patent is extended or adjusted under 35 U.S.C. 154(b) by 19 days.

(21) Appl. No.: 14/181,298

(22) Filed: Feb. 14, 2014

(65) Prior Publication Data

US 2014/0215762 A1 Aug. 7, 2014

Related U.S. Application Data

(63) Continuation-in-part of application No. 13/760,997, filed on Feb. 6, 2013, now Pat. No. 8,800,109.

(51) Int. Cl.

| | |
|---|---|
| ***E05D 11/00*** | (2006.01) |
| ***E05D 7/04*** | (2006.01) |
| ***E05F 1/12*** | (2006.01) |

(52) U.S. Cl.

CPC ..... *E05D 7/0423* (2013.01); *E05D 11/0054* (2013.01); *E05F 1/1223* (2013.01); *E05Y 2600/634* (2013.01); *Y10T 16/551* (2015.01)

(58) Field of Classification Search

CPC ..... E05D 2007/0484; E05D 11/0054; E05D 7/04; E05D 2011/0072; E05D 11/0063

USPC ..... 16/238, 236, 245, 248, 309, 312, 247, 16/382, 387

See application file for complete search history.

(56) References Cited

U.S. PATENT DOCUMENTS

| | | | | |
|---|---|---|---|---|
| 1,979,291 | A | | 11/1934 | Smith |
| 2,029,711 | A | | 2/1936 | Frantz |
| 3,858,357 | A | | 1/1975 | McGuire |
| D255,868 | S | | 7/1980 | Berkowitz et al. |
| 4,344,253 | A | | 8/1982 | Stiles |
| 4,386,449 | A | * | 6/1983 | Brustle et al. ..... 16/238 |
| 4,570,291 | A | * | 2/1986 | Smith et al. ..... 16/250 |
| 4,604,769 | A | * | 8/1986 | Rock et al. ..... 16/238 |
| 4,691,409 | A | * | 9/1987 | Torgerson et al. ..... 16/250 |
| 4,858,273 | A | * | 8/1989 | Civitelli ..... 16/86 A |
| 4,928,430 | A | | 5/1990 | George |
| 4,991,259 | A | | 2/1991 | Finkelstein et al. |
| 5,265,922 | A | | 11/1993 | Falcone |
| 5,365,639 | A | * | 11/1994 | Lewkoski ..... 16/224 |
| 5,381,627 | A | | 1/1995 | Simon et al. |

(Continued)

OTHER PUBLICATIONS

Saf-T-Cap Westinghouse Printed Apr. 17, 2015.*

*Primary Examiner* — David E Sosnowski
*Assistant Examiner* — Jason W San
(74) *Attorney, Agent, or Firm* — Baker, Donelson, Bearman, Caldwell & Berkowitz, PC; Dorian Kennedy

(57) ABSTRACT

There is disclosed an anti-sag hinge (10) which includes a mounting flange assembly (12) pivotally coupled to a strap assembly (15). The strap assembly includes a strap (31) extending from a cylinder portion (32). The strap includes an interior recess (68) and a flexible, rubber bumper or cover (90) is configured to fit snugly into the top end of the strap recess. The recess is defined by the peripheral sidewalls (74) of the strap which extend to the most outboard portion of the hinge.

8 Claims, 4 Drawing Sheets

(56) References Cited

U.S. PATENT DOCUMENTS

| | | | | |
|---|---|---|---|---|
| 5,501,348 | A * | 3/1996 | Takeuchi | 215/235 |
| D395,590 | S | 6/1998 | Finkelstein et al. | |
| D401,134 | S | 11/1998 | Finkelstein | |
| 6,049,946 | A * | 4/2000 | Cress et al. | 16/240 |
| 6,070,294 | A * | 6/2000 | Perkins | A47K 3/36 16/250 |
| 6,148,479 | A * | 11/2000 | Lin | 16/258 |
| 6,434,791 | B1 * | 8/2002 | Chung | E05D 7/0423 16/251 |
| 6,704,966 | B1 * | 3/2004 | Kao | 16/252 |
| 6,721,992 | B2 * | 4/2004 | Cotton | E05D 11/0054 16/250 |
| 6,766,561 | B1 * | 7/2004 | Cheng | 16/235 |
| 6,770,811 | B1 * | 8/2004 | Gretz | 174/50 |
| 6,880,205 | B2 * | 4/2005 | Rupprechter | 16/235 |
| 7,055,214 | B1 * | 6/2006 | Finkelstein | 16/248 |
| 7,178,197 | B2 | 2/2007 | Verheye, Sr. | |
| 7,516,516 | B2 * | 4/2009 | Wu | 16/242 |
| 7,584,523 | B1 * | 9/2009 | Finkelstein et al. | 16/260 |
| 7,614,116 | B2 * | 11/2009 | Chen et al. | 16/238 |
| 7,870,642 | B1 * | 1/2011 | Finkelstein et al. | 16/260 |
| D637,060 | S | 5/2011 | Mitchell et al. | |
| D645,725 | S | 9/2011 | Katz et al. | |
| 8,020,253 | B1 * | 9/2011 | Finkelstein et al. | 16/250 |
| D658,031 | S | 4/2012 | Mitchell et al. | |
| 8,166,612 | B2 * | 5/2012 | Bertolini et al. | 16/244 |
| 8,250,705 | B2 * | 8/2012 | Oshima | 16/236 |
| 8,250,713 | B2 * | 8/2012 | Lin | 16/367 |
| 8,434,197 | B2 * | 5/2013 | Oshima | E05D 3/186 16/241 |
| 8,499,418 | B2 * | 8/2013 | Deveze | E06B 7/362 16/250 |
| 8,505,166 | B2 | 8/2013 | Mitchell et al. | |
| 8,621,715 | B2 | 1/2014 | Mitchell et al. | |
| 2002/0078526 | A1 * | 6/2002 | Kincaid | 16/250 |
| 2004/0068840 | A1 * | 4/2004 | Thomas et al. | 16/245 |
| 2004/0154129 | A1 * | 8/2004 | Martinez-Munoz | 16/250 |
| 2006/0137139 | A1 * | 6/2006 | Wu | 16/236 |
| 2007/0169311 | A1 * | 7/2007 | Franchini | 16/236 |
| 2007/0289094 | A1 * | 12/2007 | Lowe et al. | 16/238 |
| 2008/0016648 | A1 * | 1/2008 | Lautenschlager | 16/238 |
| 2008/0271291 | A1 * | 11/2008 | Chen et al. | 16/238 |
| 2009/0193618 | A1 * | 8/2009 | Hakamata et al. | 16/250 |
| 2010/0088850 | A1 * | 4/2010 | Dringenberg | 16/251 |
| 2010/0125970 | A1 * | 5/2010 | Leimkuehler et al. | 16/251 |
| 2010/0139039 | A1 * | 6/2010 | Balbo Di Vinadio | 16/235 |
| 2011/0094057 | A1 * | 4/2011 | Duffy | 16/249 |
| 2011/0265287 | A1 * | 11/2011 | Li et al. | 16/297 |
| 2013/0067687 | A1 | 3/2013 | Mitchell et al. | |
| 2013/0067689 | A1 | 3/2013 | Mitchell et al. | |
| 2013/0167324 | A1 | 7/2013 | Mitchell et al. | |
| 2013/0219659 | A1 * | 8/2013 | Oshima et al. | 16/236 |
| 2015/0074944 | A1 * | 3/2015 | Tung | 16/251 |

* cited by examiner

HINGE

REFERENCE TO RELATED APPLICATION

This is a continuation-in-part of U.S. patent application Ser. No. 13/760,997 filed Feb. 6, 2013.

TECHNICAL FIELD

This invention relates generally to door hinges, and more particularly to hinges used for commercial refrigerator and freezer doors.

BACKGROUND OF INVENTION

Walk-in cold rooms, such as walk-in coolers, freezers, or other refrigerated environments, are common in various industries, including supermarkets and grocery stores, commercial kitchens, and other food service facilities. They typically have one or more access doors for entry and exit.

These doors are heavy and thus a common problem that may occur over time is door sag, which may cause the door not to open freely as it drags against the underlying floor or be properly locked or sealed as it does not fully close. The sag is caused by hinge wear, structural shifting due to temperature cycling, impacts, abuse, poor design of the door and frame, or the hinges shifting on the mounting screws. Sag is difficult to overcome without extensive repair work, such as the removal and remounting of the hinges or the replacement of the door and frame. For the replacement, adjustment or cleaning of the hinge the NSF prefers that the hinge be a "lift-off" type to allow the door and the enclosure to be cleaned by lifting it off the hinges and hosing down the door assembly.

A problem associated with these "lift-off" type hinges is that the hinge spring is designed to move the cam past the point of door closure to ensure a complete closing of the door, this may be referred to as an over-closure angle between the hinge strap and hinge flange. As a result of the over-closure of the cam when the door is taken off the hinge, the subsequent replacement of the door upon the hinge flange does not always result in the proper alignment of the hinge strap upon the hinge flange. This problem can result in the poor closure function of the hinge, the misalignment of the hinge components, and/or damage to the hinge.

Another problem associated with these hinges is that they are made of metal which when contacted with a cart or other loading equipment may become scratched, scarred, dented or otherwise damages both physically and aesthetically. Additionally, this accidental contact may result in causing damage to the cart or other loading equipment. Some hinges are made of a combination of metal components with a hard plastic covering, as shown in U.S. Pat. No. 7,870,642. These hard plastic covers however may crack or break upon collision with a cart or the like.

Accordingly, there is a need in the art for a hinge that will allow for the door to be lifted off easily, which does not promote door sag, which allows small adjustments to the hinge, and which also reduces damage to the hinge or the a contacting piece of equipment should an accidental contact or collision occur. It is to the provision of such therefore that the present invention is primarily directed.

SUMMARY OF THE INVENTION

In a preferred form of the invention a hinge comprises a mounting flange assembly having at least one mounting flange assembly mounting hole, and a strap assembly pivotally coupled to the mounting flange assembly. The strap assembly includes a strap having at least one strap mounting hole and a coupling end pivotally coupled to the mounting flange. The strap also has metal peripheral sidewalls defining a strap recess and a rubber bumper positioned at least partially within the strap recess and at least partially outside the strap recess.

DETAILED DESCRIPTION

Figure 1:
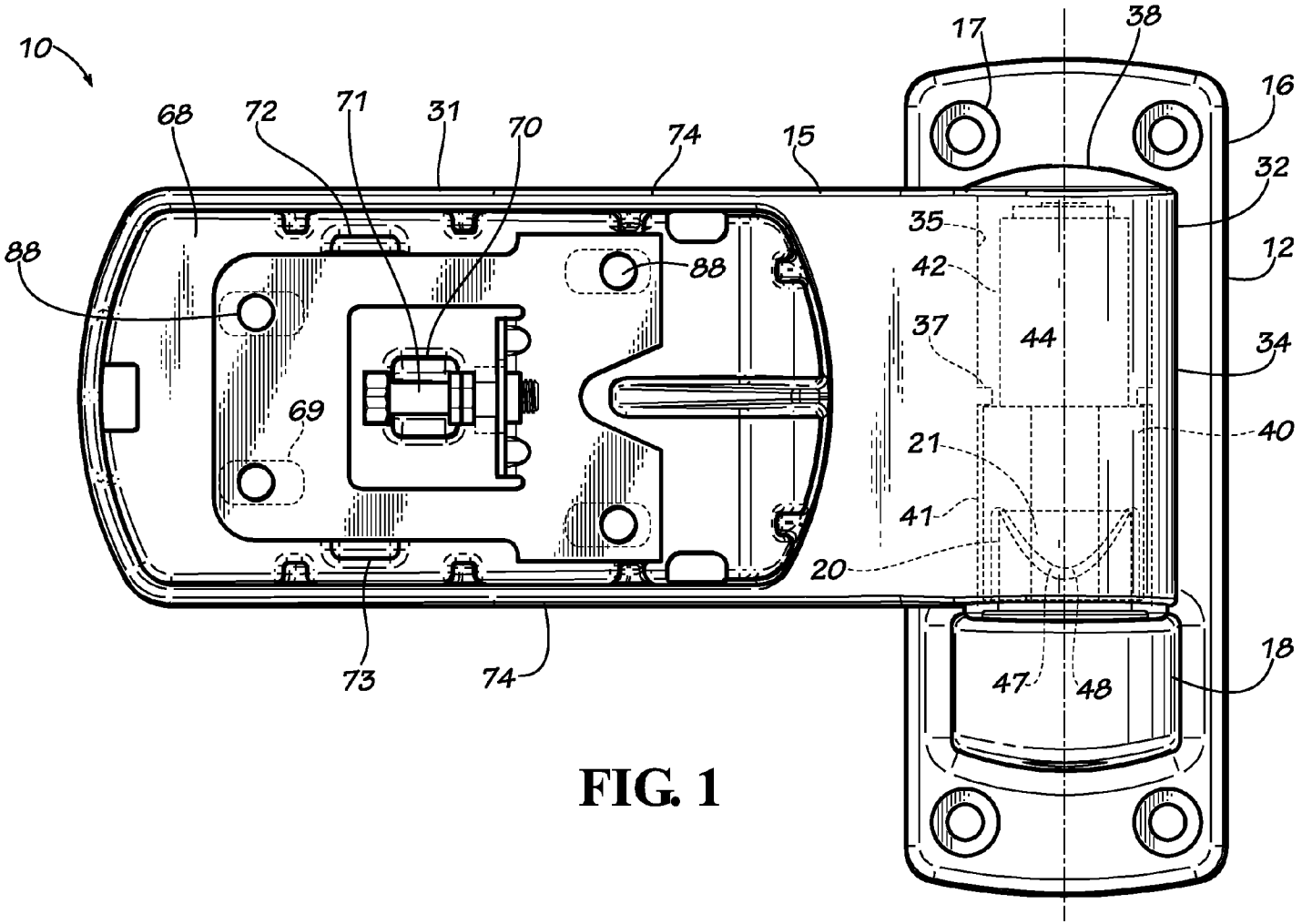
FIG. 1 is a front view of an anti-sag hinge embodying principles of the invention in a preferred form.
Figure 2:
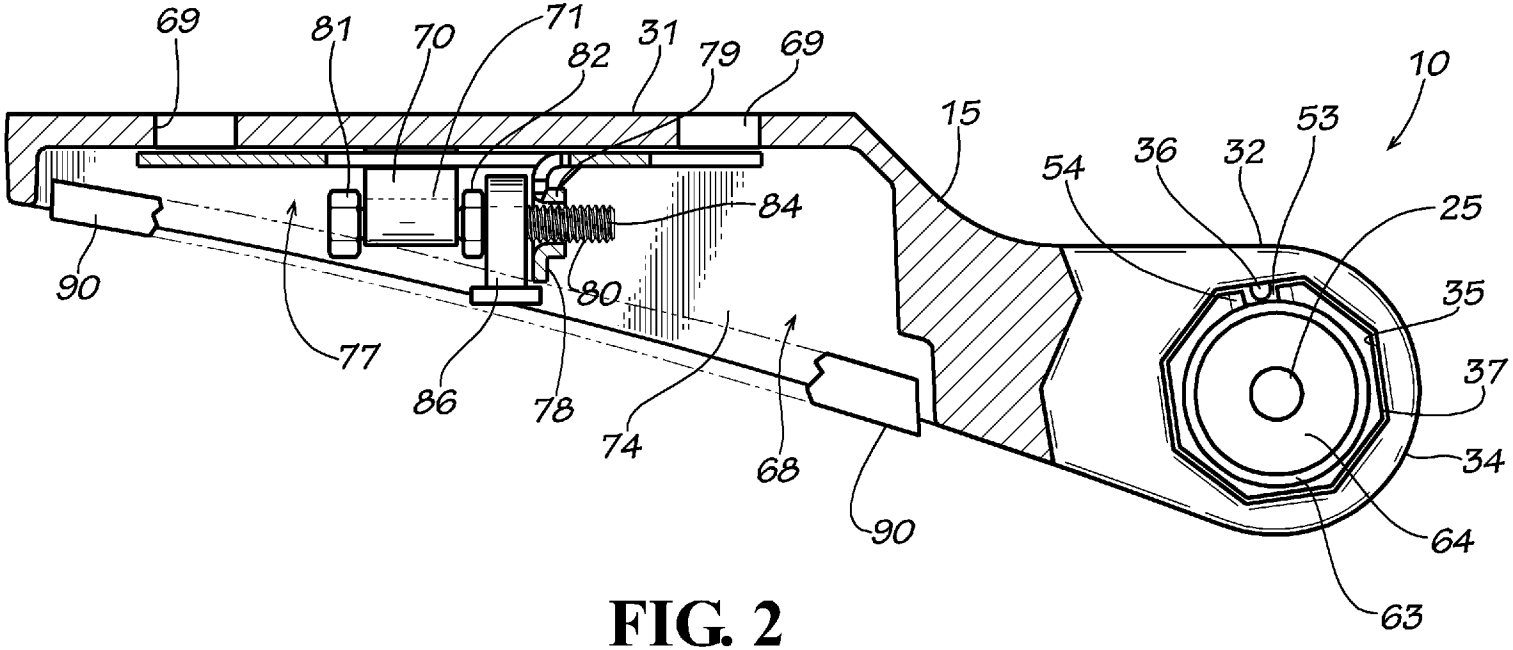
FIG. 2 is a top view of the anti-sag hinge of FIG. 1, shown in partial cross-section.
Figure 3:
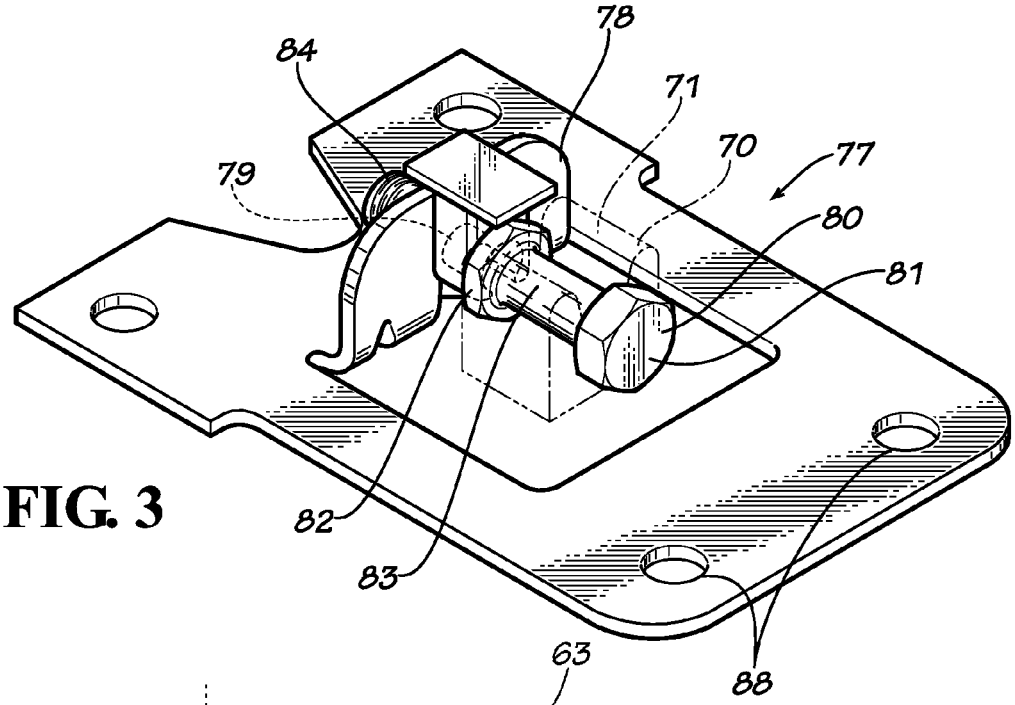
FIG. 3 is a perspective view of a portion of the anti-sag hinge of FIG. 1.
Figure 5:
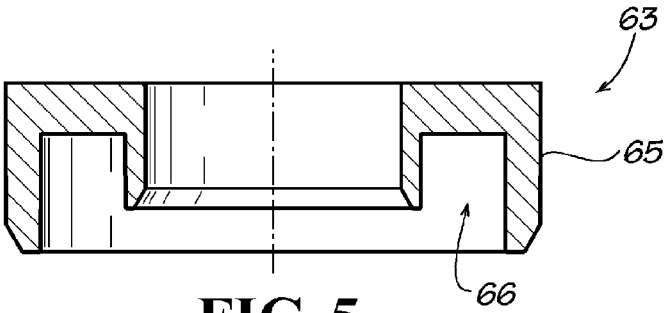
FIG. 5 is a cross-sectional view of a bushing of the anti-sag hinge of FIG. 1.
Figure 6:
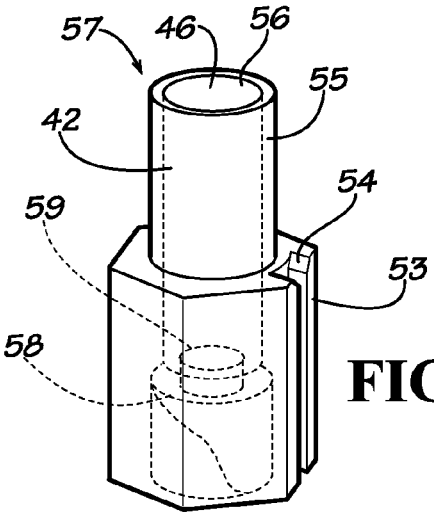
FIG. 6 is a perspective view of the cam follower of the anti-sag hinge of FIG. 1.
Figure 7:
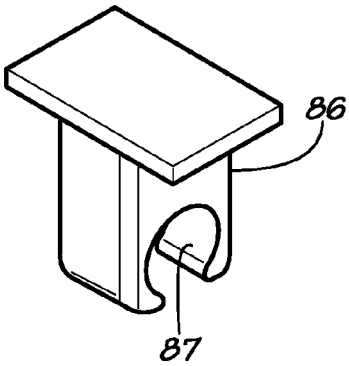
FIG. 7 is a perspective view of the spacer of the anti-sag hinge of FIG. 1.
Figure 4:
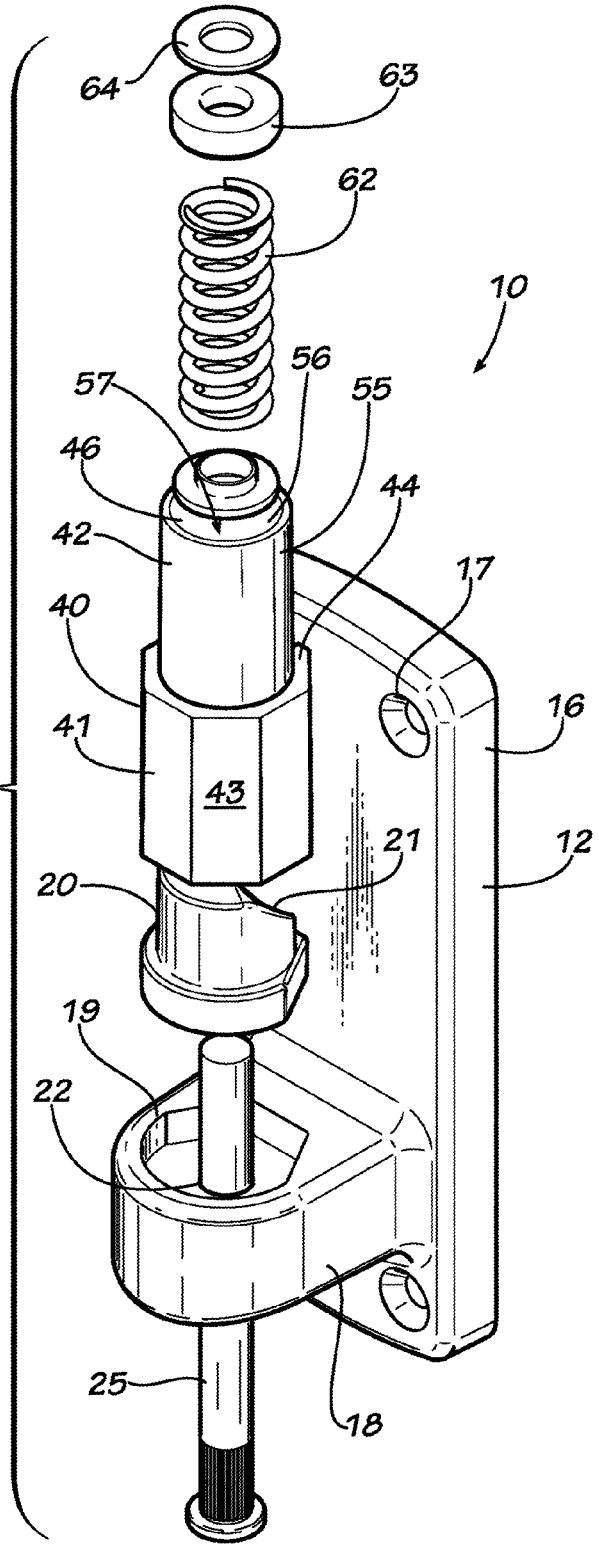
FIG. 4 is an exploded view of the anti-sag hinge of FIG. 1.

With reference next to the drawings, there is shown a lift-off type anti-sag hinge 10 according to the present invention. The hinge 10 includes a mounting flange assembly 12 pivotally coupled to a strap assembly 15. It is to be appreciated that the hinge 10 shown in the drawings is configured for use with a walk-in refrigerator or freezer door. The jamb and doors are well-known in the art and need not be disclosed further herein. It is to be further appreciated that the hinge 10, either alone or in combination with another hinge in accordance with the present invention, support a door (not shown) in the usual manner.

The mounting flange assembly 12 includes a metal mounting plate 16 having four mounting holes 17 therethrough adapted to receiving unshown mounting bolts or screws, and a metal lower hinge flange 18 extending from the mounting plate 16. As used throughout the entire disclosure herein, the terms screw and bolt are used interchangeably. The lower hinge flange 18 includes a cam recess 19 configured to receive a cam assembly which has an internally mounted cam 20 and cam follower 40 which enables the hinge to be a riser type hinge, although this is merely an option of the present invention. The cam 20 includes a dual sloped camming surface 21. The cam 20 and later described cam follower 40 are preferably made of a smooth, low-frictional plastic material such as nylon. The lower hinge flange 18 also includes a shoulder bolt hole 22 therethrough in which is mounted a shoulder bolt or rod 25.

The strap assembly 15 includes a metal elongated strap 31 extending from a cylinder portion 32. The term cylinder portion 32 is meant to describe the enlarged casing located at the end of the strap and the encased bearings, spring, and cam described in more detail hereinafter. The term cylinder portion is not intended to be limited to a cylinder shape, as this portion or parts of this portion may be of many known shapes and are not necessarily cylindrical in shape.

The cylindrical portion 32 includes a coupling end 34 with a vertically extending octagonal channel 35 therethrough. The octagonal channel 35 includes a generally vertically extending alignment ridge or tongue 36 extending longitudinally along the channel 35 and a centrally positioned, horizontally oriented, annular ridge 37 which generally bisects the channel 35. A cap 38 is pressed into and seals the top opening of the channel 35. The cylindrical portion 32 also houses the elongated earn follower 40 having a lower cam follower portion 41 and an upper cam follower portion 42. The lower cam follower portion 41 has an octagonal exterior surface 43 terminating at a circumferential ledge or shoulder 44 positioned to abut and bear against the centrally positioned annular ridge 37 of the coupling end 34. It should be noted that the coupling end octagonal channel 35 is longitudinally symmetric about the centrally positioned annular ridge 37 so that the cam follower 40 may be positioned in either end, thereby making it reversible (either left hand or right hand door configurable) so that the cam follower may fit in the octagonal channel 35 from either open end. The lower cam follower portion 41 also has an interior surface 46 with a cam following surface 47 configured to mesh or mate with the cam camming surface 21. The cam following surface 47 includes a low point or low point area 48 flanked on either side by symmetrical incline surfaces which terminate at a common dwell surface. The symmetry allows the cam follower to rise with rotation in either direction so that the hinge may be mounted to both right hand and left hand opening doors. The lower cam follower portion 41 also has a longitudinally extending slot or groove 53 configured to receive the coupling end alignment tongue 36. The groove 53 has a camber 54 in the ledge 44 (cambered entrance) at its top end which aids in initially guiding the tongue 36 into the groove as the strap assembly is coupled with the mounting flange assembly 12 with the cam follower being inserted into the mounting end octagonal channel 35. The groove 53 is aligned along the exterior surface directly opposite the low point 48, so that the groove 53 extends into or corresponds to the longest portion of the camming surface to allow for the greatest degree of strength or minimizing the weakening of component due to the absence of material created by the groove 53.

The upper cam follower portion 42 is generally cylindrical with a round exterior surface 55 and a round interior surface 56 defining an interior channel 57 commencing at an interior floor 58. A bolt or rod hole 59 passes through the center of the cam follower in which resides the shoulder rod 25 so that the cam follower 40 may rotate or pivot about the shoulder rod and relative to the underlying cam 20.

The strap assembly 15 also includes a compression spring 62 positioned concentrically about the shoulder rod 25 and within cam follower interior channel 56. A bushing 63 and washer 64, positioned on top of the bushing 63, are also positioned concentrically about the shoulder rod 25 and within the cam follower interior channel 56. The bushing 63 has a peripheral flange 65 with an annular bottom recess 66 configured to receive a topmost portion of the compression spring 62, which enables the spring 62 to be maintained tightly in position while still allowing lateral room for the spring to expand during spring compression under load, i.e., with the spring under no load there is room between the spring and the interior surface 56 which allows the spring to laterally expand when it is vertically compressed and therefore laterally expanded under a load. The top of the shoulder rod 25 is blunted or deformed to prevent the removal of the washer 64 and thereby the bushing 63 and spring 62. The compression of the spring 62 biases the cam follower 40 to its lowermost position, which will correlate with the closed position of the refrigerator door or an over-closure position past the closed position of the refrigerator door, and a such the hinge shown in the drawings is a self-closing type hinge.

The strap 31 includes a large interior well or recess 68 having four elongated mounting holes 69, an adjustment screw flange, holder or boss 70 having a screw hole or passageway 71 therein, an upper guide 72 and a lower guide 73. A flexible, rubber bumper or cover 90 is configured to fit snugly into the top end of the strap recess 68 to protect and seal the interior of the strap assembly, the bumper may include tabs which fit within corresponding tab holes or grooves in the strap to make is easily removable. The recess 68 is defined by the peripheral sidewalls 74 of the strap 31 which extend to the most outboard portion of the hinge, i.e., the peripheral sidewalls 74 extends outwardly from the underlying door to a top or front edge so as to make contact with any structure colliding with or impacting upon the hinge should the rubber cover 90 be compressed to a certain degree. As used, herein the term top or front edge is meant to refer to the sidewall edge farthest from or facing away from the door and is not intend to denote actual orientation or height in a vertical direction. Similarly, the rubber cover 90 extends above the sidewall edges, wherein above is intended to denote a farther extension from the door and is not intended to denote above in vertical orientation. The adjustment screw boss passageway 71 preferably is U-shaped so as to have an open top configuration.

The strap 31 also includes a moveable adjustment bracket 77 mounted for lateral movement relative to the underlying strap 31. The vertical movement of the adjustment bracket 77 is limited by the upper guide 72 and lower guide 73. The adjustment bracket 77 also includes an adjustment screw mounting flange 78 having a threaded screw hole 79 therein in which is threadably mounted an adjustment screw 80. The adjustment screw 80 has a head 81, a bearing flange 82, a neck 83 extending between the head 81 and bearing flange 82, and an externally threaded shaft 84 which is threaded into mounting flange screw hole 79. A removable spacer 86 is removably mounted to the adjustment screw 80. The spacer 86 has a U-shaped gripping portion 87 which is snap fitted onto a neck portion of the threaded shaft 84 between the bearing flange 82 and the adjustment bracket screw flange 78. Lastly, the adjustment bracket 77 includes four mounting holes 88 extending therethrough and generally in alignment with strap elongated mounting holes 69.

In use, the hinge 10 is mounted to the refrigerator or freezer door in the conventional manner as is well known in the art. The mounting plate 16 is secured to the jamb by the use of screws (not shown) that extend through the mounting plate mounting holes 17 and into the jamb. A conventional walk-in refrigerator or freezer door is similarly secured to the hinge 10 by four screws (not shown) that extend through the four mounting holes 88 of the strap assembly adjustment bracket 77 and through the four elongated mounting holes 69 of the strap 31. The removable spacer 86 is initially positioned so that the adjustment bracket mounting holes 88 are aligned with the strap mounting holes 69. Once the flange assembly mounting screws are secured and the strap assembly mounting screws are partially secured but not finally tightened, final adjustment of the adjustment bracket may occur to level the door.

To adjust the bracket, the removable spacer 86 is removed and the adjustment screw 80 is rotatably threaded into the threaded hole 79 of the screw adjustment flange 78 to cause relative movement between the adjustment bracket 77 and the underlying strap 31. This relative movement causes the movement of the door relative to the stationary jamb, as the elongated holes 69 allow relative movement of mounting screws and adjustment bracket. The movement of the door enables the door to be properly aligned. The mounting screws are then fully tightened into the door to prevent further movement of the strap 31. Moreover, should the door sag over time, the mounting screws are slightly loosened and the adjustment screw is merely threaded to once again cause movement of the door to a properly aligned position, as previously described.

The rotation of the adjustment screw 80 in one direction (clockwise) causes the threaded screw 80 to be threaded further into the screw flange 78 of the adjustment bracket 77, thereby causing the adjustment bracket 77 to move towards the boss 70. The rotation of the threaded screw 80 in this direction causes the screw head 81 to bear against the boss 70 to force the lateral movement. The rotation of the adjustment screw 80 in the other direction (counter-clockwise) causes the threaded screw 80 to be threaded further out of the adjustment bracket flange 78, thereby causing the adjustment bracket 77 to move in a direction away from the boss 70. The rotation of the threaded screw 80 in this direction causes the screw bearing flange 82 to bear against the boss 70 to force the lateral movement in a direction away from the boss 70. As such, the bolt is allowed to rotate yet is prevented from moving laterally along the longitudinal axis of the bolt by the contact between the bolt and the boss due to the bolt head and bearing flange bearing upon the boss.

The rubber cover 90 and peripheral sidewall front or top edges define a front face or surface of the strap 31 with the rubber cover comprising a majority of the front face and the peripheral sidewalls 74 completely surround the rubber cover 90. As such, should a food cart or other piece of equipment collide with the hinge 10 the rubber cover 90 will absorb the shock of the impact without causing damage as its flexibility will prevent cracking and it will rebound to its initial configuration. If a larger or more forceful impact occurs, the equipment will first compress the rubber cover and then come into contact with the hard metal peripheral wall which is better suited to take on the greater forces produced by a larger collision without causing damage to the hinge. As such, the new hinge provides for a soft material to absorb the initial shock of a collision without causing a permanent scratch or scarring of the metal, yet may absorb a larger impact by allowing a portion of a larger strike to contact the stronger, hard metal peripheral sidewall 74 after it is first partially absorbed by the rubber bumper or cover 90.

It should be understood that the present invention is an improvement over the prior art shown in U.S. Pat. No. 7,870,642 as the threaded portion in which the adjustment screw is threaded into resides in the removable adjustment plate. This allows the manufacturing of the threads in the mounting hole to occur in a simple manner, as oppose to the prior art which required the threading process to occur on the large, heavy flange of the strap itself, thus complicating the manufacturing process of the hinge and causing a great deal of problems if the threads were not properly formed. Furthermore, if the threads become stripped or damaged only the adjustment bracket needs to be replaced rather than the entire hinge strap.

It should also be understood that the open channel or passageway 71 of the boss allows for the ease of positioning the adjustment bracket by simply dropping the adjustment screw neck 83 into the boss wherein the spacer is utilized to maintain the position of the adjustment screw.

It should be understood that the lower portion 41 of the cam follower is not required to be hexagonal in shape and may be of any shaped which aids in preventing relative rotation between the can follower and its corresponding channel, i.e., it may be oval, any polygonal shape, or any other non-round shape. Preferably, the cam follower has regular polygon exterior configuration wherein all sides and angles are equal, such as the octagonal shape shown in the preferred embodiment.

It should be understood that the softer rubber cover or bumper 90 allows for contact without breaking, which may occur with the prior art devices that utilize a hard plastic cover over the metal hinge components. Also, the rubber cover or bumper is soft so that it extends beyond the sidewall front edges to absorb an impact force and rebounds to its initial configuration, which all metal hinges may be susceptible to damage through bending, denting, scratching as a result of a collision. It should be understood that the term rubber or soft rubber as used herein is intended to denote a rubber or similar polymer based material which is resilient, compressible, and rebounds to its initial configuration, rather than a plastic material which is hard and is susceptible to cracking rather than compressing and rebounding with accidental contact.

It should be understood that the terms cam and cam follower may be used interchangeably, as each simply includes a sloping surface configured to ride upon the other's sloping surface.

While this invention has been described in detail with particular reference to the id preferred embodiments thereof and the best mode of practicing same, it will be understood that variations and modifications can be effected within the spirit and scope of the invention as described herein above and as set forth in the appended claims.

The invention claimed is:

1. A hinge adapted to be mounted to a door comprising: a mounting flange assembly having at least one mounting flange assembly mounting hole, and a strap assembly pivotally coupled to said mounting flange assembly, said strap assembly including a strap having at least one strap mounting hole and a coupling end pivotally coupled to said mounting flange, said strap having a rear surface facing the door and a front surface opposite said rear surface facing away from the door, said strap front surface including a metal peripheral sidewall defining a strap front facing recess and a rubber bumper positioned at least partially within said strap recess and at least partially outside said strap recess along said front surface, such that upon a collision said rubber bumper absorbs an initial impact and allows said sidewall to further absorb a larger impact.

2. The hinge of claim 1 wherein said peripheral sidewall has a top edge, and wherein said rubber bumper extends beyond said top edge of said peripheral sidewall.

3. The hinge of claim 1 wherein said rubber bumper is removably mounted to said strap sidewall.

4. The hinge of claim 1 wherein said rubber bumper comprises a majority of said front surface of said hinge.

5. A cold room hinge adapted to be mounted to a door, the cold room hinge comprising: a mounting flange assembly, and a strap assembly pivotally coupled to said mounting flange assembly, said strap assembly including a strap having a peripheral sidewall and a resilient and compressible bumper, a rear facing surface facing the door, and a front facing surface facing away from the door, said front facing surface including said resilient and compressible bumper and a hard peripheral edge of said peripheral sidewall surrounding said bumper, such that upon a collision said resilient and compressible bumper absorbs an initial impact and allows said sidewall to further absorb a lamer impact.

6. The cold room hinge of claim 5 wherein said bumper extends beyond said peripheral edge.

7. The cold room hinge of claim 5 wherein said bumper is removably mounted to said strap sidewall.

8. The cold room hinge of claim 5 wherein said bumper comprises a majority of said front facing surface of said hinge.

* * * * *